US007325541B2

(12) United States Patent
Marcakis

(10) Patent No.: US 7,325,541 B2
(45) Date of Patent: Feb. 5, 2008

(54) ADJUSTABLE PRIMARY AIR SUPPLY FOR WOOD BURNING DEVICE

(76) Inventor: Emmanuel Marcakis, 3594, Jarry Est, Montreal, Quebec (CA) H1Z 2G4

( * ) Notice: Subject to any disclaimer, the term of this patent is extended or adjusted under 35 U.S.C. 154(b) by 437 days.

(21) Appl. No.: 11/169,036

(22) Filed: Jun. 28, 2005

(65) Prior Publication Data

US 2005/0284462 A1 Dec. 29, 2005

Related U.S. Application Data

(60) Provisional application No. 60/583,132, filed on Jun. 28, 2004.

(51) Int. Cl.
*F24C 1/14* (2006.01)

(52) U.S. Cl. ..... 126/77; 126/285 R; 126/99 F; 126/101 D

(58) Field of Classification Search ..... 126/77, 126/285 R, 502, 193, 101 D, 99 F; 112/289, 112/193, 290; 236/99 F
See application file for complete search history.

(56) References Cited

U.S. PATENT DOCUMENTS 4,052,136 A 10/1977 Ulricksen
4,206,743 A * 6/1980 Niemela ..... 126/110 B
4,350,141 A 9/1982 Miller
4,362,146 A 12/1982 Schuller
4,409,956 A 10/1983 Barnett
4,530,346 A 7/1985 Roy
4,533,315 A 8/1985 Nelson
4,651,709 A 3/1987 Schnetker
6,041,770 A * 3/2000 Erickson ..... 126/77

* cited by examiner

*Primary Examiner*—Terrence R Till
*Assistant Examiner*—Nikhil Mashruwala

(57) ABSTRACT

An adjustable primary air supply for wood burning device comprises at least one but preferably two thermostatic bimetal elements which, by bending with temperature variations, directly actuate a flap that opens and closes the air entry opening. Primary Air is the air used to control the burn rate and it is adjusted in order to achieve the desired burn rates and Secondary Air is the air used to complete the combustion and is not adjustable. Using these two sources of air, the invention consists of a device, which allows the primary air supply to remain open until proper burning is established. Therefore, when the temperature of the appliance rises, the combustion air gradually decreases to its preset value by having the primary air supply automatically shut off as temperature increases. A higher temperature indicates that the wood is sufficiently hot to decompose into flammable gases, so only secondary air is required to continue the combustion process.

9 Claims, 4 Drawing Sheets

Figures 1, 2, 3, 4:
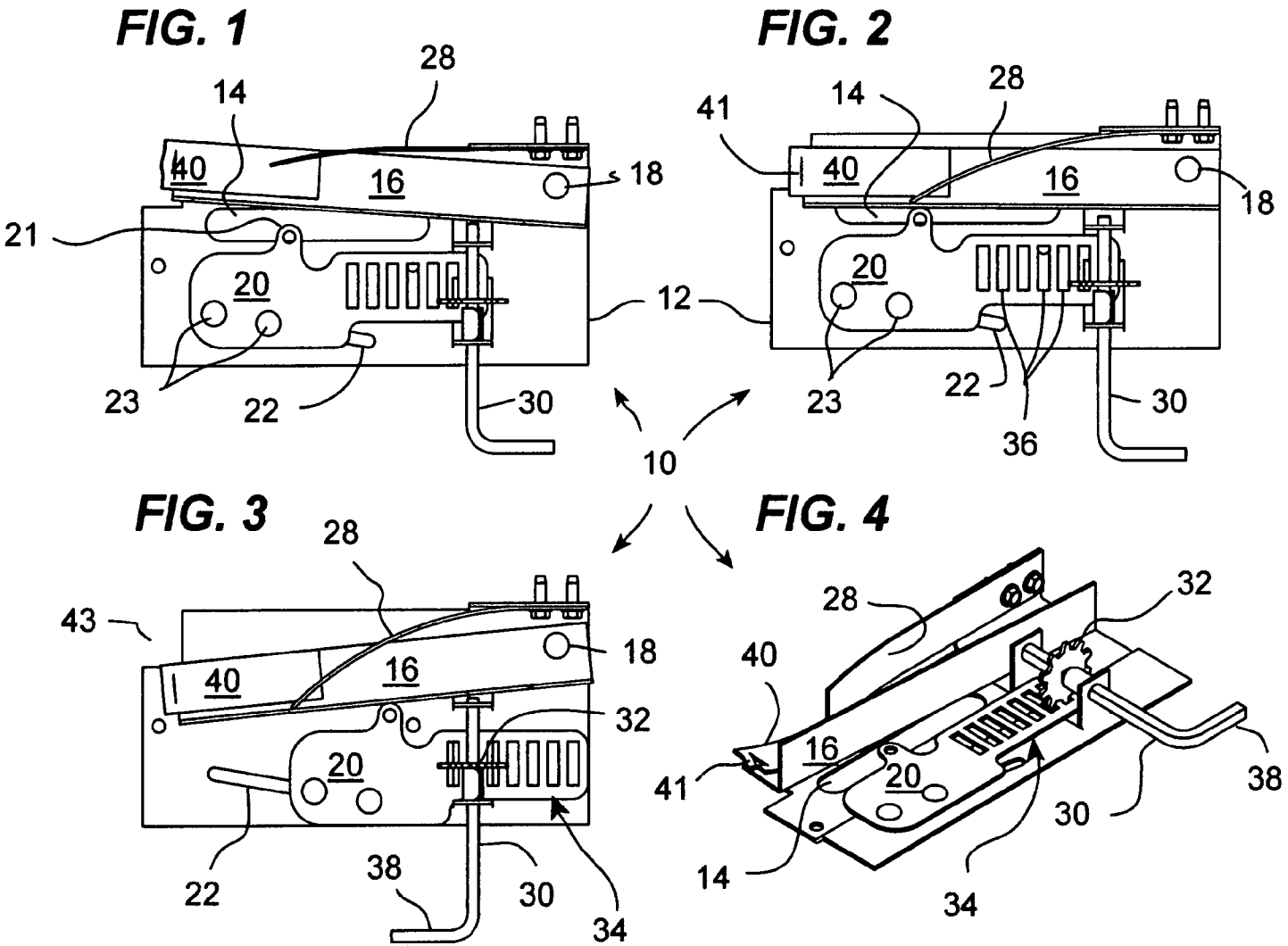

10
12
14
16
18
20
21
22
23
28
30
32
34
36
38
40
41
43

ADJUSTABLE PRIMARY AIR SUPPLY FOR WOOD BURNING DEVICE

This application claims priority based on provisional application 60/583,132 filed Jun. 28, 2004 for claims 1, 3, 6.

BACKGROUND OF THE INVENTION

1. Field of the Invention

The invention relates generally to wood burning appliances but more particularly to an adjustable control that provides variable air intake resulting in efficient and clean burning.

2. Background of the Invention

Wood burning appliances must conform to Environmental Protection Agency (EPA) standards for emission control. Appliances are tested based on a range of burn rates from the minimum to the maximum. The test starts by preheating the appliance in a predetermined manner, and then follows a test procedure as specified in the EPA standards.

EPA imposes the following restrictions and requirements:

Restriction: The operator cannot make adjustments of the combustion air after the first five minutes of the test.

Requirements: The appliance must be able to burn less than 1 kg of wood per hour while producing less than 7.5 grams of pollutants per hour.

The following problems arise:

For a low burn rate (less than 1 kg per hour), the combustion air must be set to a minimum. In this case, the time allowed to start the fire (5 minutes) is not sufficient. Therefore, the wood does not burn properly producing excess pollutants.

In order to account for that, it is necessary to have a variable air intake or preferably a second air intake that is used for starting a fire quickly and which can be shut down when the fire is considered to be in a condition for continued burning with sufficient combustible material and air intake which provides for a burn in accordance with EPA standards.

There are a number of slow combustion stoves disclosed in the prior art, they generally make use of a thermostat to actuate changes in the combustion process such as bringing in more fuel or changing the air-fuel ratio. Such examples can be found in U.S. Pat. No. 4,052,136 wherein a thermostat is arranged to be responsive to the temperature of flue gases from an oil burning heater and actuates switches when the temperature of the flue gases reaches either a predetermined high value or a predetermined low value.

U.S. Pat. No. 4,409,956 also describes a thermostat for a stove wherein the thermal control unit is contained in a housing which has an aperture formed therein and includes a thermal control unit for detecting changes in the temperature of the stove. A flap is secured to the housing and is rotatable across the aperture so as to cover the aperture to any desired degree.

U.S. Pat. No. 4,530,346 shows a mechanical thermostat for modulating the temperature of a solid fuel-burning stove, including a casing, a thermostat coil mounted in the casing to sense the stove wall plate temperature; a downwardly-spaced air admission mechanism. The air admission mechanism includes a pair of identical openable and closable orifices by way of a variable closure mechanism.

The problem with thermostat is that they are merely switches actuating a generally electromechanical process which will effect the required change. This involves a plurality of components, any one of which can be prone to failure.

SUMMARY OF THE INVENTION

In view of the foregoing disadvantages inherent in the known devices now present in the prior art, the present invention, which will be described subsequently in greater detail, is to provide the advantage of providing for a simple mechanical system to adjust air entry for efficient burning.

To attain this end, the present invention generally comprises at least one but preferably two thermostatic bimetal elements which, by bending with temperature variations, directly actuate a flap that opens and closes the air entry opening.

Primary Air (PA) is the air used to control the burn rate and it is adjusted in order to achieve the desired burn rates and Secondary Air (SA) is the air used to complete the combustion and is not adjustable. Using these two sources of air, the invention consists of a device, which allows the PA supply to remain open until proper burning is established. Therefore, when the temperature of the appliance rises, the combustion air gradually decreases to its preset value by having the PA supply automatically shut off as temperature increases. A higher temperature indicates that the wood is sufficiently hot to decompose into flammable gases, so only secondary air is required to continue the combustion process.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE PREFERRED EMBODIMENT

FIG. 1 Perspective view of the device.

FIG. 2 Top view of the device with the PA open.

FIG. 3 Top view of the device with the PA partially closed.

FIG. 4 Top view of the device with the PA completely closed by manually adjusting the handle.

FIG. 5*a* Top view

Figures 5A, 5B, 5C:
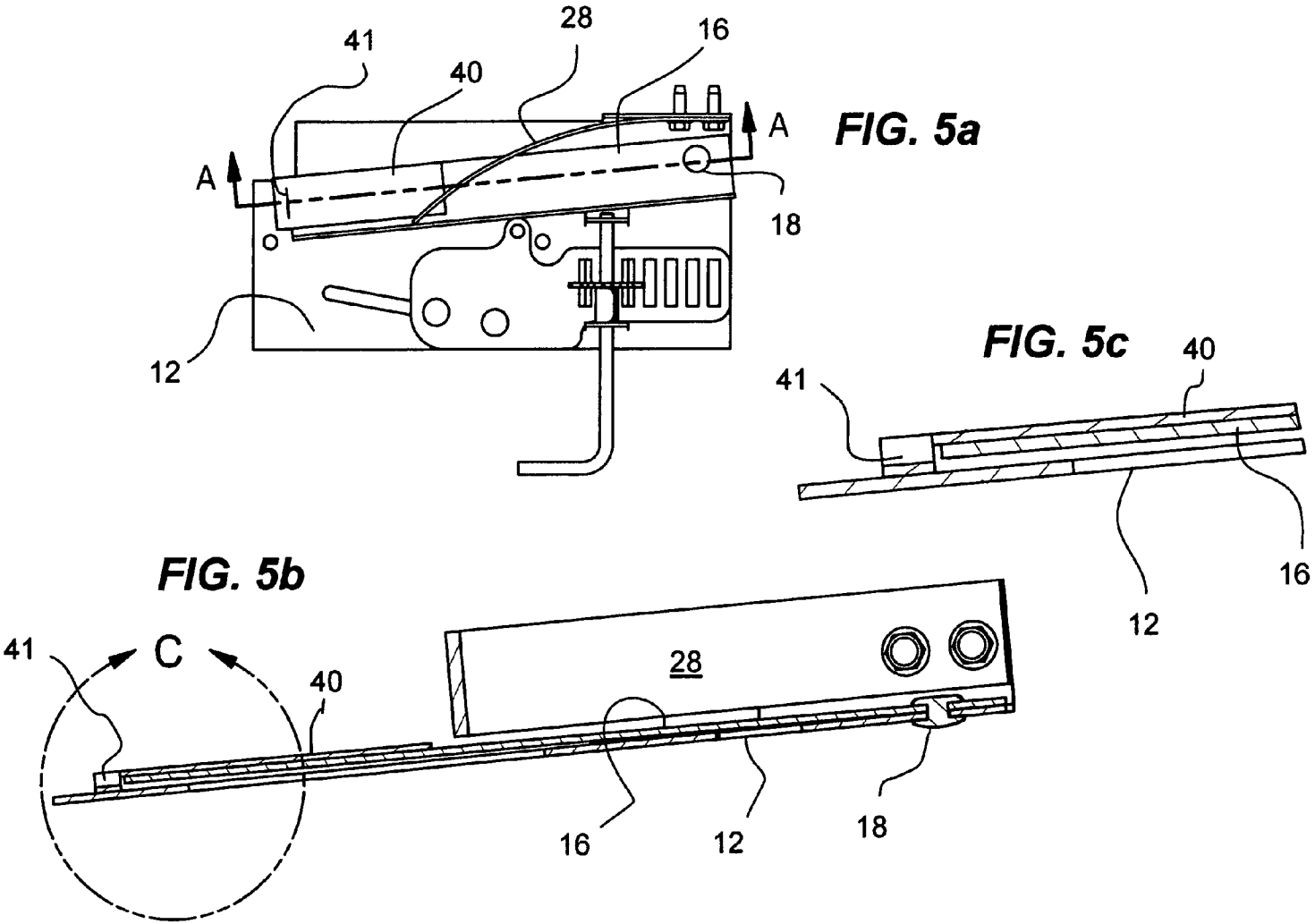

FIGS. 5*bc* Side view along line M of FIG. 5*a* and side view detail respectively of the thermostatic bimetal when hot.

Figure 6B:
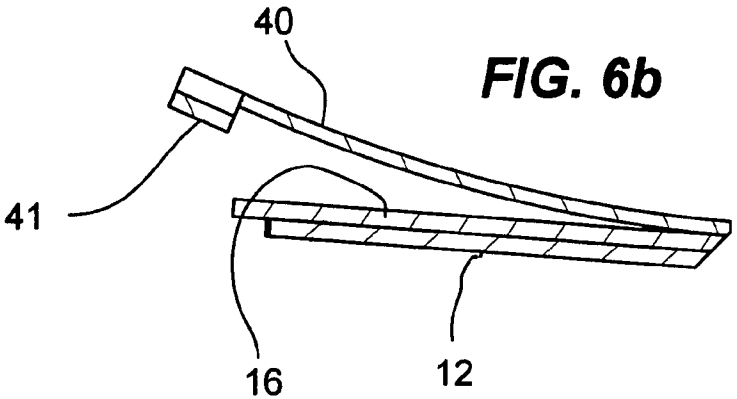
Figure 6A:
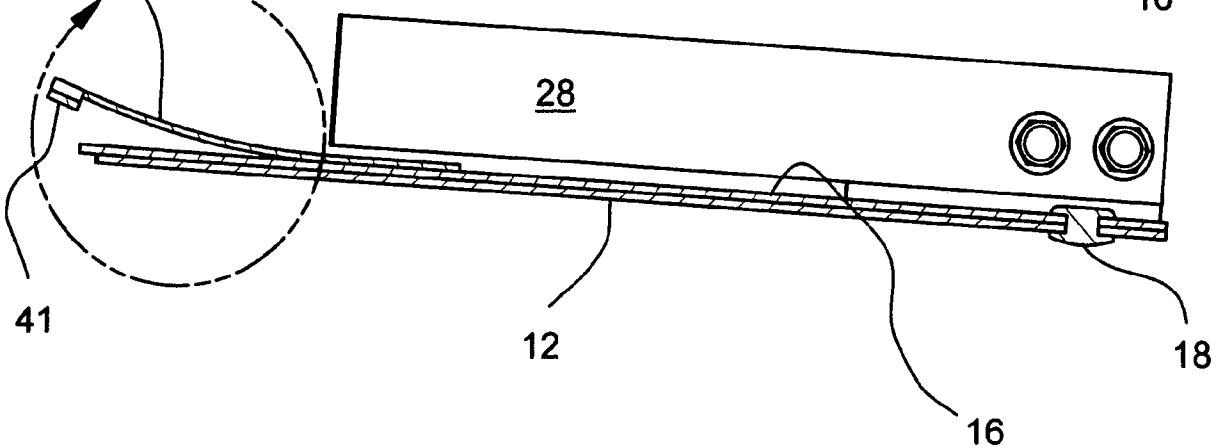

FIGS. 6*ab* Side view and side view detail respectively as in FIGS. 5*bc* but when the thermostatic bimetal when cold.

Figure 7:
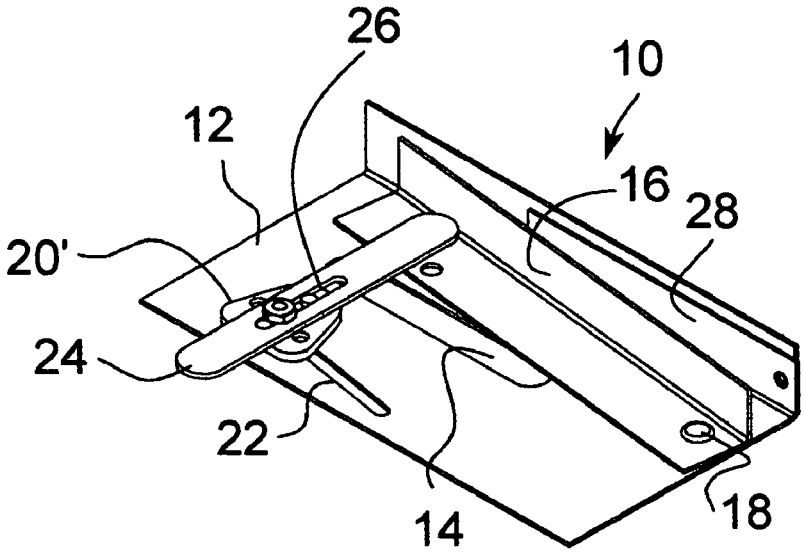

FIG. 7 Perspective view of alternate embodiment.

DETAILED DESCRIPTION OF THE PREFERRED EMBODIMENT

An adjustable primary air supply for wood burning device (10) has a base plate (12) into which is an opening (14) from where PA enters a firebox (not shown). An "L" shaped gate (16) is rotationally attached to the base plate (12) by way of a mechanical fastener (18) which holds gate (16) somewhat loosely in order to allow for easy rotation but also for another reason which will be described later. A slider (20) slides, as guided within an inclined slot (22) by guiding means (23) generally in the form of rivets or short pegs. The slider (20) is comprised of a contact point (21) which makes contact with the gate (16) in order to limit displacement range of the gate (16) as may be required. A first thermostatic bimetal blade (28) reacts to heat by bending in a plane parallel to the base (12). The first thermostatic bimetal blade (28) can be attached to a raised part of the base (12) or any such convenient location.

FIG. 1 illustrates the configuration when starting a fire, at which point the PA is open to bring in as much air as possible. In order to fully open the PA, the gate (16) is pushed by a means, in the form of a key (30) in this figure, being pushed inwardly in the direction of arrow (17). As the firebox gets warmer, The first bimetal blade (28) begins to bend as per FIG. 2, this pushes the gate (16) which closes the opening (14), this will also push the key (30) outwardly. In FIG. 2, the gate (16) only partially blocks the opening (14) because the slider (20) is so positioned so as to block any further displacement of the gate (16). In FIG. 3 shows that by moving the slider (20) along the inclined slot (22), the gate (16) is allowed to fully close the opening (14) as long as there is enough heat to bend the first bimetal blade (28) to do so. In order to vary the position of the slider (20), the key (30) is turned to rotate a cog wheel (32) which engages into a track (34) composed of a plurality of holes (36). For design purposes, the handle part (38) of the key (30) can be made into a knob for easier handling by a user.

The amount of the PA varies depending on the position of the slider (20). It will be possible for the user to establish the optimum position of the slider (20) depending on the heating requirements. Thus, the adjustments will be limited to opening the gate (16) by moving the slider (20) when starting the fire or after adding the wood. When the first bimetal blade (28) gets colder, it retracts to its original configuration but the gate (16) stays at the same position. That way, the PA is reduced to the minimum amount required for minimum burn rate.

An important feature of the device (10) is that it can reduce the PA automatically. The PA can be reset manually only when the temperature in the firebox drops. It allows automatic adjustments of the PA beyond the restriction of the five minute manual adjustments. In addition, the device (10) also allows the user to set and maintain a consistent burning rate.

While the fire burns reasonably hot, the PA cannot be adjusted beyond the range determined by the position of the slider (20). For burn rates less than the maximum (gate (16) half closed) a second thermostatic bimetal blade (40) extending from the gate (16), to which it is mechanically attached, raises the gate (16) slightly as per FIG. 5*c*. Since, as mentioned earlier, mechanical fastener (18) holds gate (16) somewhat loosely, downward pressure exerted by the second thermostatic bimetal blade (40) pushes the gate (16) upward so as to create a small opening allowing air in. At the minimum burn rate, the gate (16) is completely closed by the first bimetal blade (28) but it is slightly raised by the second bimetal blade (40) allowing a small amount of PA to enter the firebox, which is sufficient to maintain proper combustion. By the end of the burning cycle, as the temperature drops, the second bimetal blade (40) returns to a bent shape which allows the gate (16) to close completely. The second bimetal blade (40) is equipped with a boss (41) which is only useful when the gate (16) is fully closed since, as per FIG. 1*a* the boss (41) is over an empty area (43) whereas when the gate is fully closed, it interacts with the base (12).

FIG. 7 shows a variation of adjustable primary air supply for wood burning device (10) wherein the << L >> shaped gate (16) is oriented differently and the slider (20') is shaped differently. Whereas the slider (20) in all other figures is actuated by the key (30) which can take on the guise of a rotary knob, this slider (20') has a control handle (24) which can take on the guise of a sliding knob. The slider (20') can also push the gate (16) as the key (30) can. FIG. 7 is in fact how the invention looked at the filing of the US provisional and did not have the secondary bimetal and is shown here just to show as an example of various shapes the slider (20) can take. This version has a slit (26) which allows for further adjustment between the slider (20') and the gate (16).

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. An adjustable primary air supply for wood burning device comprising:

a base plate having an opening from where primary air enters a firebox;

a gate rotationally attached to said base plate by way of a mechanical fastener;

a slider with guiding means sliding within an inclined slot;

said slider comprised of a contact point which makes contact with said gate for adjustments;

a first thermostatic bimetal blade reacting to heat by displacing said gate so that said gate closes said opening;

a means to move said slider and push said gate fully open.

2. An adjustable primary air supply for wood burning device as in claim 1 having the following method of operation:

when starting a fire, said gate being open to bring in as much air as possible;

said bimetal blade bend as it gets warmer;

said first bimetal blade pushing said gate so that it closes said opening up until either the bimetal blade stops bending or said gate being blocked by said slider according to said slider's position along said inclined slot;

when said first bimetal blade gets colder, it retracts to its original configuration but said gate staying at the same position.

3. An adjustable primary air supply for wood burning device as in claim 1 wherein:

said means to move said slider and push said gate fully open being a key;

said key being turned to rotate a cog wheel which engages into a track composed of a plurality of holes.

4. An adjustable primary air supply for wood burning device as in claim 1 wherein:

amount of said primary air being varied by position of said slider.

5. An adjustable primary air supply for wood burning device as in claim 1 wherein:

a second thermostatic bimetal blade to raise said gate by way of a boss pushing down on said base.

6. An adjustable primary air supply for wood burning device as in claim 5 having the following method of operation:

at minimum burn rate, said gate being completely closed by said first thermostatic bimetal blade but said gate being raised by said second thermostatic bimetal blade allowing a small amount of primary air to enter said firebox;

by the end of burning cycle, as the temperature drops, said second thermostatic bimetal blade returning to a bent shape which allows said gate to close completely.

7. An adjustable primary air supply for wood burning device as in claim 5 wherein:

said second thermostatic bimetal blade extending from said gate to which it is mechanically attached.

8. An adjustable primary air supply for wood burning device as in claim 5 wherein:

said second thermostatic bimetal blade having said boss being useful only when situated over said base.

9. An adjustable primary air supply for wood burning device as in claim 5 wherein:

said gate being pushed by said key when said key being pushed inwardly.

* * * * *